US007497602B2

(12) United States Patent
Lien

(10) Patent No.: US 7,497,602 B2
(45) Date of Patent: Mar. 3, 2009

(54) THREE DIMENSION COLLAPSIBLE LAMPSHADE

(75) Inventor: Wen-Cheng Lien, No. 33, Yanji St., Sanmin Dist., Kaohsiung (TW)

(73) Assignees: Wen-Cheng Lien, Kaohsiung (TW); Chao-Chih Chen, Taoyuan Hsien (TW)

( * ) Notice: Subject to any disclaimer, the term of this patent is extended or adjusted under 35 U.S.C. 154(b) by 0 days.

(21) Appl. No.: 11/703,685

(22) Filed: Feb. 8, 2007

(65) Prior Publication Data

US 2008/0192486 A1 Aug. 14, 2008

(51) Int. Cl.
*F21V 1/06* (2006.01)

(52) U.S. Cl. ..... 362/352; 362/357; 362/440; 362/450

(58) Field of Classification Search ..... 362/351, 362/352, 355, 356, 357, 358, 361, 434, 440, 362/441, 449, 450
See application file for complete search history.

(56) References Cited

U.S. PATENT DOCUMENTS 3,142,446 A * 7/1964 Okamoto ..... 362/352
3,162,377 A * 12/1964 Hidertaro ..... 362/450
4,354,222 A * 10/1982 Gall ..... 362/352
5,375,048 A * 12/1994 Barnes ..... 362/352
6,315,434 B1 11/2001 Long
6,960,004 B1 * 11/2005 Hsieh ..... 362/434
7,210,824 B2 * 5/2007 Lu ..... 362/352
2003/0189833 A1 10/2003 Chen

* cited by examiner

*Primary Examiner*—Y My Quach Lee
(74) *Attorney, Agent, or Firm*—Muncy, Geissler, Olds & Lowe, PLLC

(57) ABSTRACT

A three dimension collapsible lampshade mainly includes a collapsible rib foldable on a cubical surface and a pliable fabric cover foldable on a plane. The pliable fabric cover has a flexible ring at a lower rim that may be fixed or folded in a desired shape. The collapsible rib and the pliable fabric cover are separable. By coupling the collapsible rib and the pliable fabric cover a cubical lampshade can be formed. The lampshade may also be folded in three dimensions. Compared with the conventional lampshades that are foldable only in two dimensions, the invention can save the cost of package material and transportation. The separable design also allows consumers to change and replace the pliable fabric cover as desired after purchase.

1 Claim, 14 Drawing Sheets

THREE DIMENSION COLLAPSIBLE LAMPSHADE

FIELD OF THE INVENTION

The present invention relates to a three dimension collapsible lamp shade.

BACKGROUND OF THE INVENTION

U.S. patent publication No. 20030189833 discloses a lampshade, referring to FIG. 1. The lamp shade 10 has a bracing rib 11 with one end pivotally coupled with an upper ring 12 through a movable joint 13 and other end pivotally coupled with a lower ring 14 in the same way. By means of such a construction the upper and lower rings 12 and 14 and the bracing rib 11 can be collapsed to fold the lamp shade 10 in a flattened and circular manner as shown in FIG. 2, with the folded bracing rib 11 located beneath a fabric cover 15.

FIG. 3 shows another U.S. Pat. No. 6,315,434 which also is a collapsible lampshade. It has an upper ring 21, a lower ring 22, a plurality of hinges 23 located at a lower end of the upper ring 21 and an upper end of the lower ring 22 to be coupled respectively with a post 24 to support and extend a fabric cover 25. To collapse the lampshade, the post 24 is removed as shown in FIG. 4. Then a flattened and circular lampshade 20 is formed. The post 24 is stored separately. If the post 24 is lost, the lampshade becomes useless.

The conventional lampshades as previously discussed are collapsible on a cubical surface in a vertical space. They differ only in the structure. Referring to FIG. 5, they aim to fold the lampshade 10 (20) on the cubical surface to save space. Such structures still have problems remained to be solved, notably:

1. Collapsed Area:

As shown in FIG. 5, after the lampshade 10 (20) has been collapsed, it is folded only in the direction of the cubical surface (Z axis). While the size shrinks after collapse, the collapsed lampshade still has to be packaged separately for shipping. This results in a higher cost of the package material and transportation. The present invention proposes a three dimension collapsible lampshade that can form a shrunk size as shown in FIG. 6. Folding ribs foldable on a cubical surface can be disposed beneath a pliable fabric cover folding on a plane to reduce the cost of package material and transportation.

2. Replacing of the Pliable Fabric Cover:

The conventional lampshades as shown in FIGS. 1 and 3 have the pliable fabric cover fastened to the upper or lower ring, and cannot be removed and replaced. Nowadays consumers like to have alterations and different styles. The conventional design cannot meet such a requirement.

SUMMARY OF THE INVENTION

The three dimension collapsible lampshade according to the invention provides a pliable fabric cover and a collapsible rib that are separable. They can be coupled and extended to form a cubical lampshade, and also can be collapsed in a three dimensional folding manner. The collapsible rib has a desired stiffness. A flexible ring is provided to be coupled with the collapsible rib to extend the pliable fabric cover. The extended rib can be inserted into an insertion hole to extend the pliable fabric cover in a smooth and neat fashion.

According to an embodiment of the invention, the pliable fabric cover is hollow and has a flexible ring at the bottom. The fabric has a plurality of insertion holes at a lower rim. The pliable fabric cover further has an upper ring at a lower end of the top portion thereof that is fastened in a semi-fixing manner (such as tying). A plurality of bars is provided below the upper ring to be pivotally coupled with a main bracket of the collapsible rib so that they are collapsible. There is also a secondary bracket collapsible against the main bracket that has an insertion strut on other end to be coupled with the insertion hole at the lower rim of the pliable fabric cover and the flexible bottom ring.

When the invention collapses, through the main bracket, secondary bracket and upper ring pivotally coupled with the main bracket, it can be folded on the cubical surface below the upper ring. As the pliable fabric cover can be separated from the upper ring, it can be removed from the folded rib. The flexible rib at the bottom of the pliable fabric cover can be folded in an up and down manner on a plane after the pliable fabric cover has been removed at a size fitting in the upper ring. Hence the invention can be held in a package box of a lamp stand after assembly in the plant without additional package material. As a result the cost of package material and transportation can be reduced. Moreover, as the pliable fabric cover is removable, consumers can choose and buy different styles of pliable fabric cover for replacement after purchase. Storage also is easier when not in use.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 2:
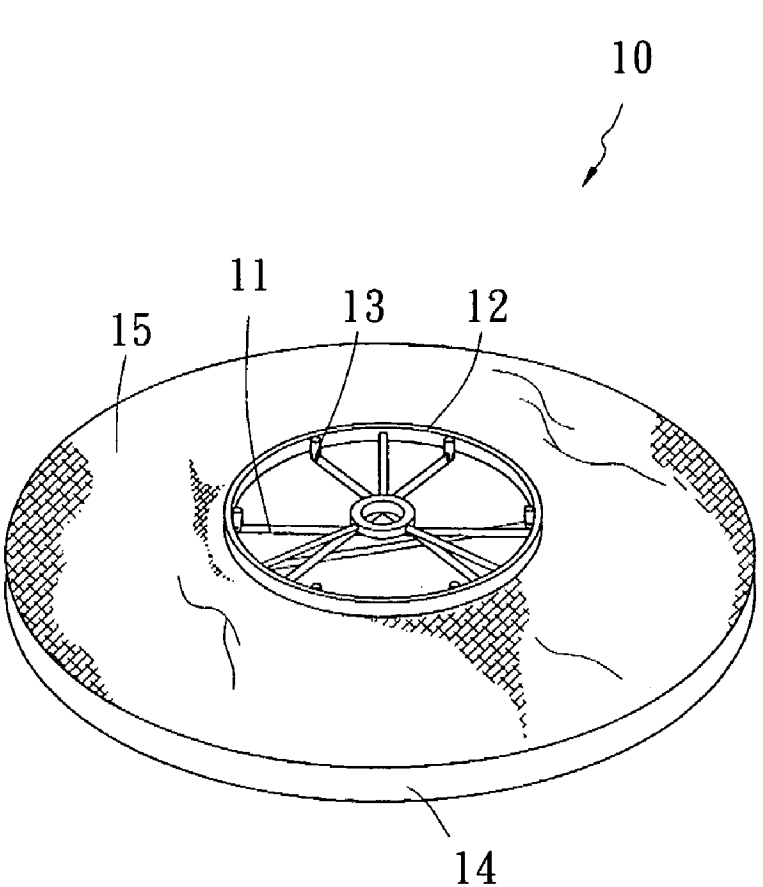
Fig. 2 PRIOR ART
FIG. 2 is a schematic view of the lampshade according to FIG. 1 in a collapsed condition.
Figure 1:
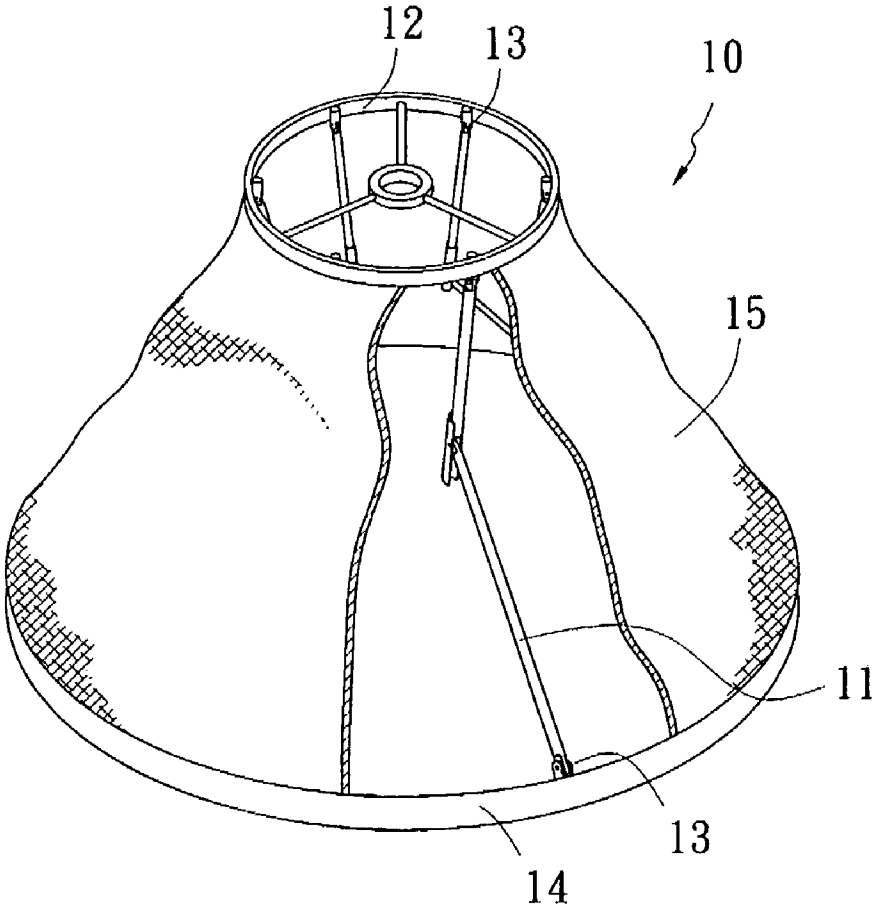
Fig. 1 PRIOR ART
FIG. 1 is a perspective view of the lampshade of U.S. patent No. 20030189833.
Figure 4:
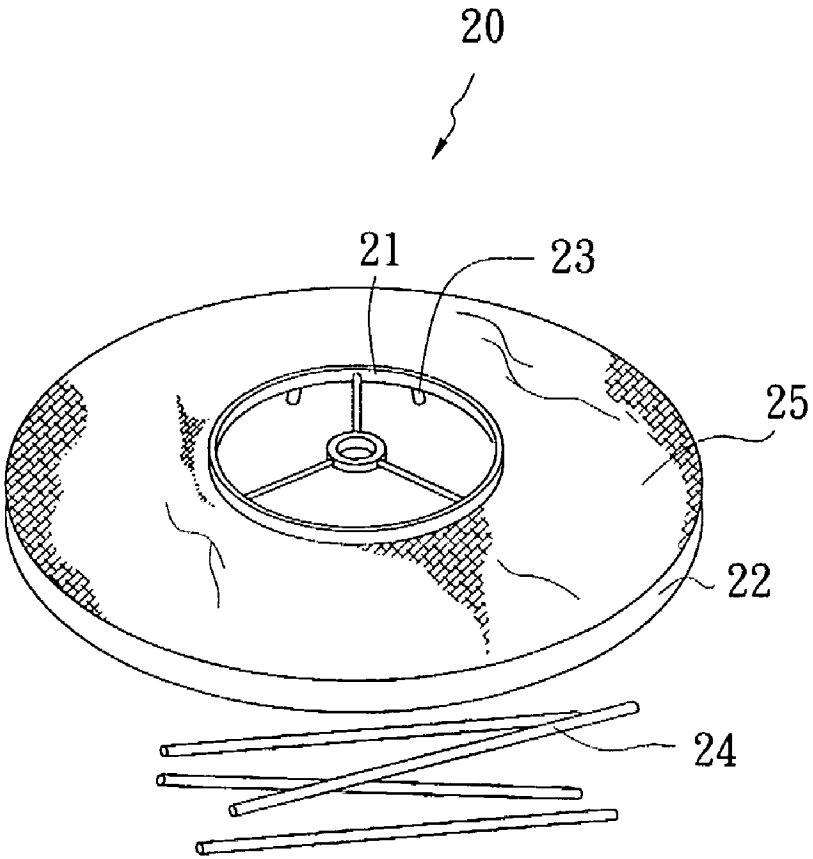
Fig. 4 PRIOR ART
FIG. 4 is a schematic view of the lampshade according to FIG. 3 in a collapsed condition.
Figure 3:
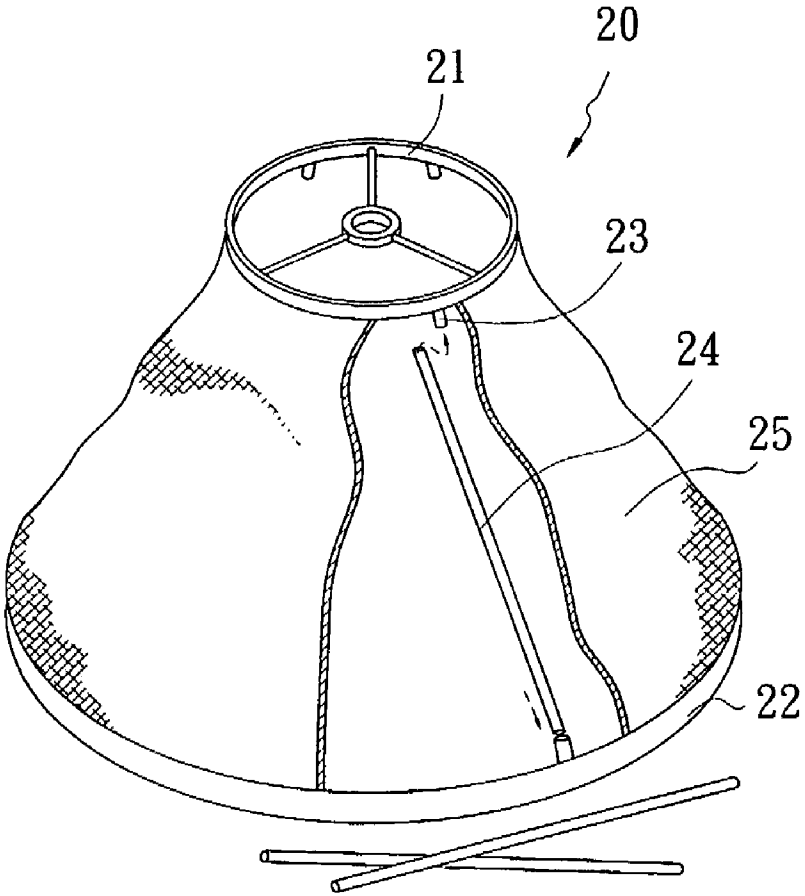
Fig. 3 PRIOR ART
FIG. 3 is a perspective view of the lampshade of U.S. Pat. No. 6,315,434.
Figure 6:
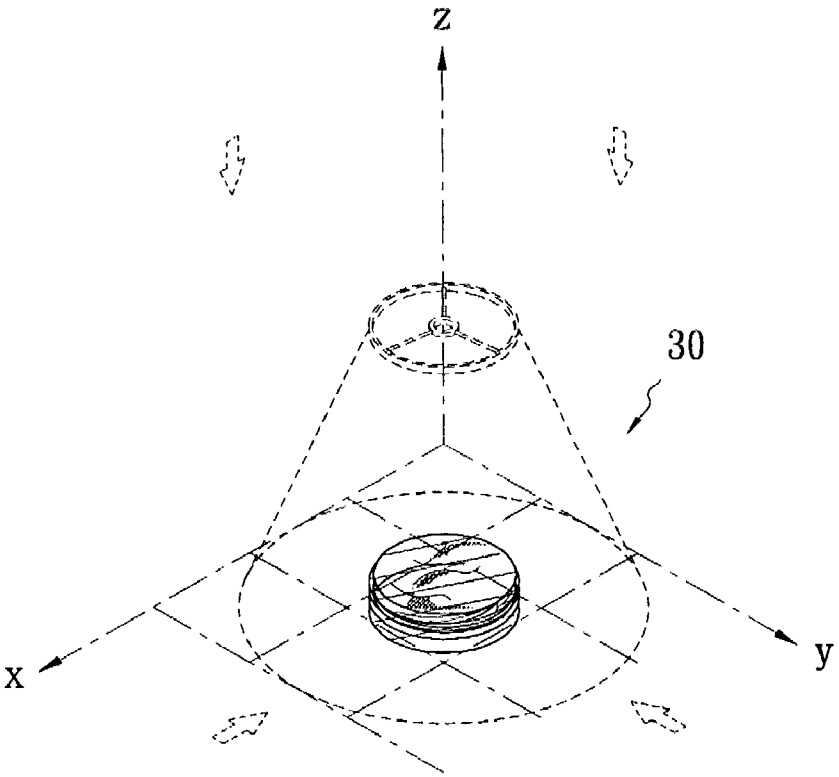
FIG. 6 is a schematic view of the lampshade of the invention in an extended condition and a collapsed condition at three dimensions.
Figure 5:
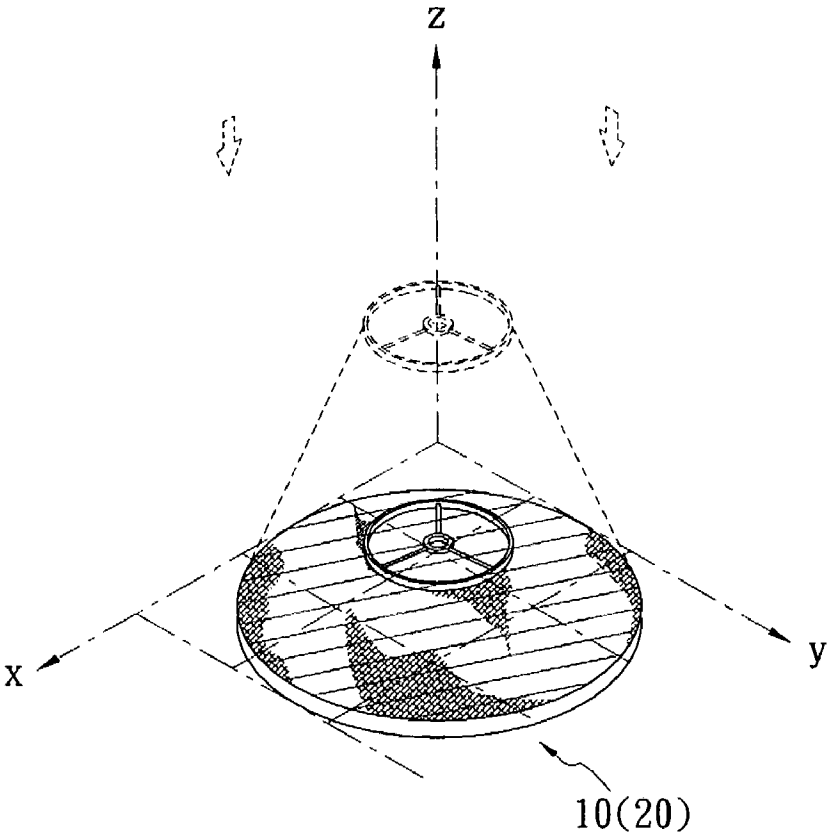
Fig. 5 PRIOR ART
FIG. 5 is a schematic view of a conventional lampshade in an extended condition and a collapsed condition at two dimensions.
Figure 7:
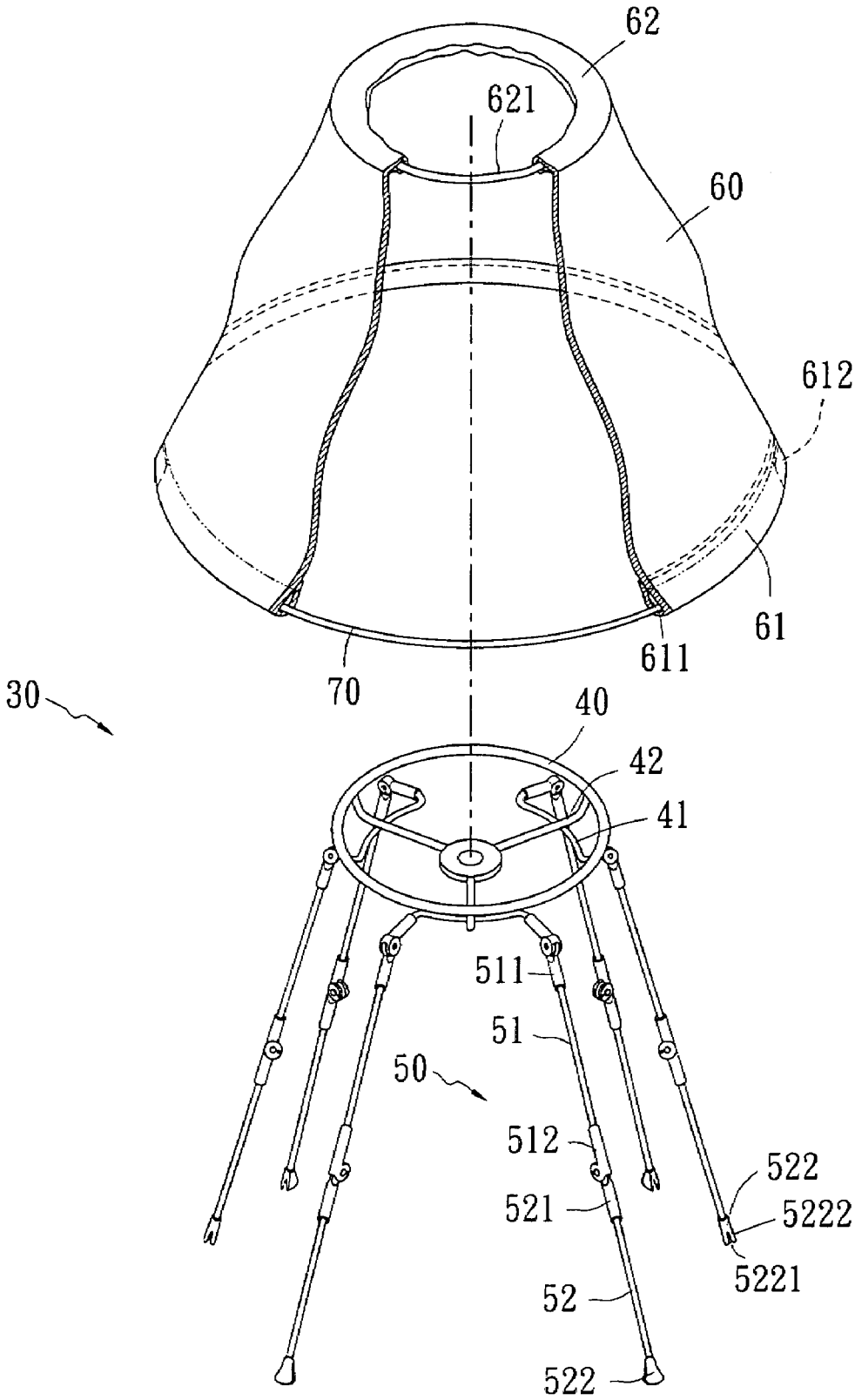
FIG. 7 is an exploded view of the invention.
Figure 8:
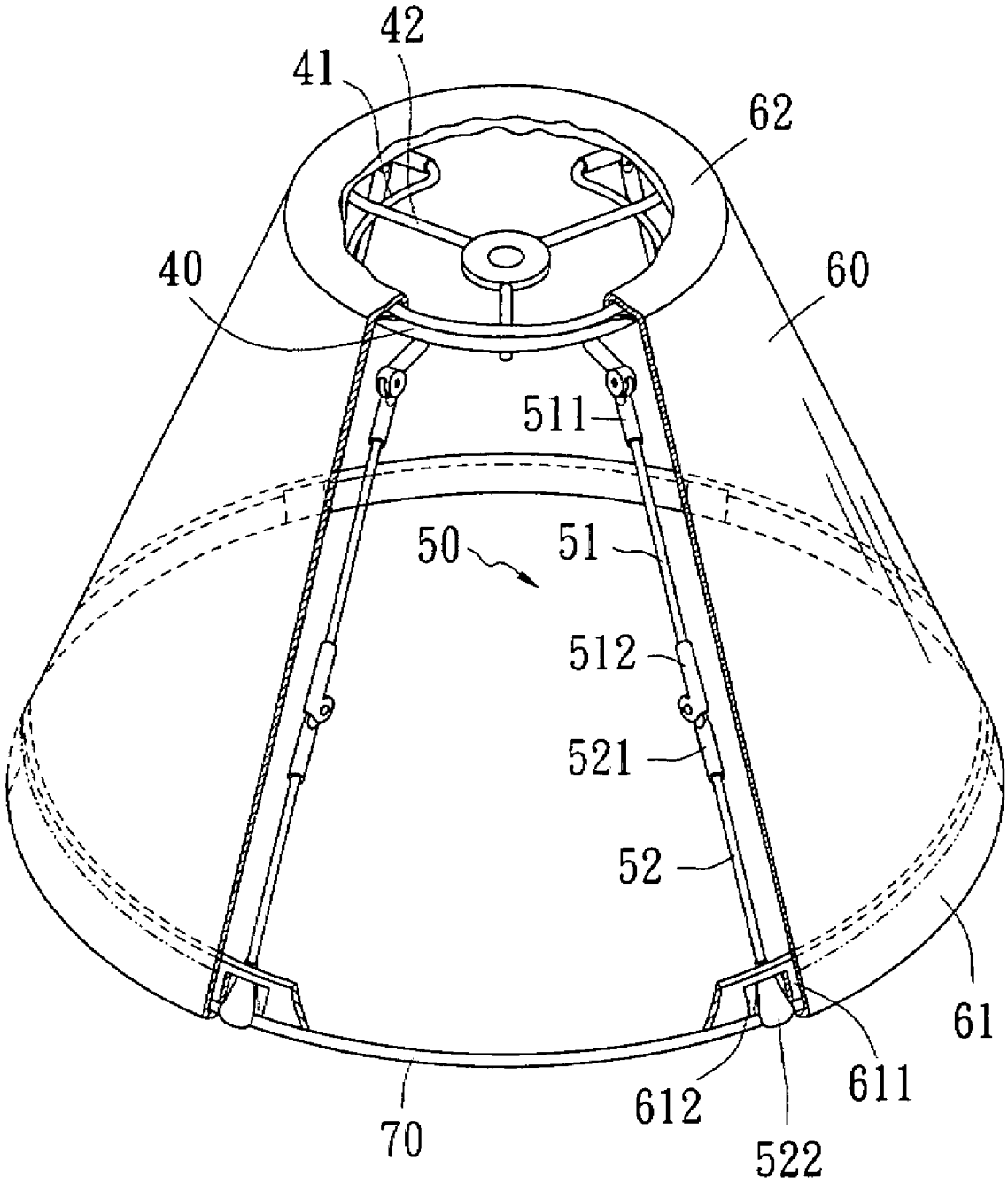
FIG. 8 is a schematic view of the invention in an assembled condition.

Please refer to FIGS. 7 and 8 for an embodiment of the three dimension collapsible lampshade of the invention. It includes at least a collapsible rib 50 foldable on a cubical surface with an upper ring 40 pivotally coupled with an upper rim thereof and a pliable fabric cover 60 foldable on a plane. The pliable fabric cover 60 has a lower rim coupled with a flexible ring 70 which may be formed in a desired shape or folded. The collapsible rib 50 and the pliable fabric cover 60 can be coupled and extended to form a cubical lampshade 30. They also may be collapsed respectively to form a three dimensional folding.

The upper ring 40 has a plurality of bars 41 on a lower side and reinforced bars 42 linked on an inner side to increase the strength of the upper ring 40.

The collapsible rib 50 includes a main bracket 51 and a secondary bracket 52 that can be folded against each other on a cubical surface. The main bracket 51 has connecting portions 511 and 512 at two ends. The connecting portion 511 is pivotally coupled with the bar 41. The secondary bracket 52 has a coupling portion 521 at one end to be pivotally coupled with another connecting portion 512 of the main bracket 51 and an insertion strut 522 at other end that has a latch trough 5221 and two insertion plates 5222 formed in a juxtaposed manner.

Figure 9:
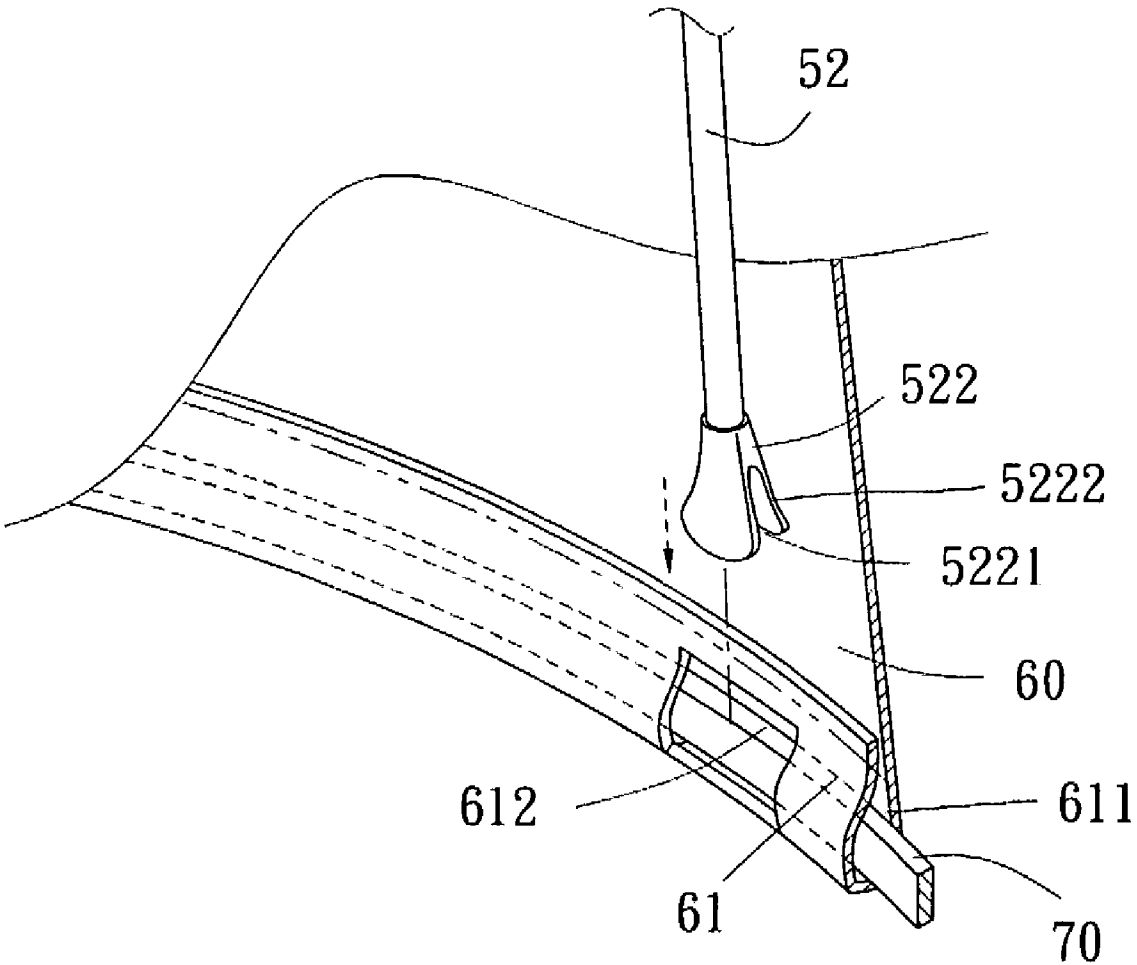
FIG. 9 is a fragmentary schematic view of the invention showing the collapsible rib and flexible bottom ring in a coupling condition.
Figure 10:
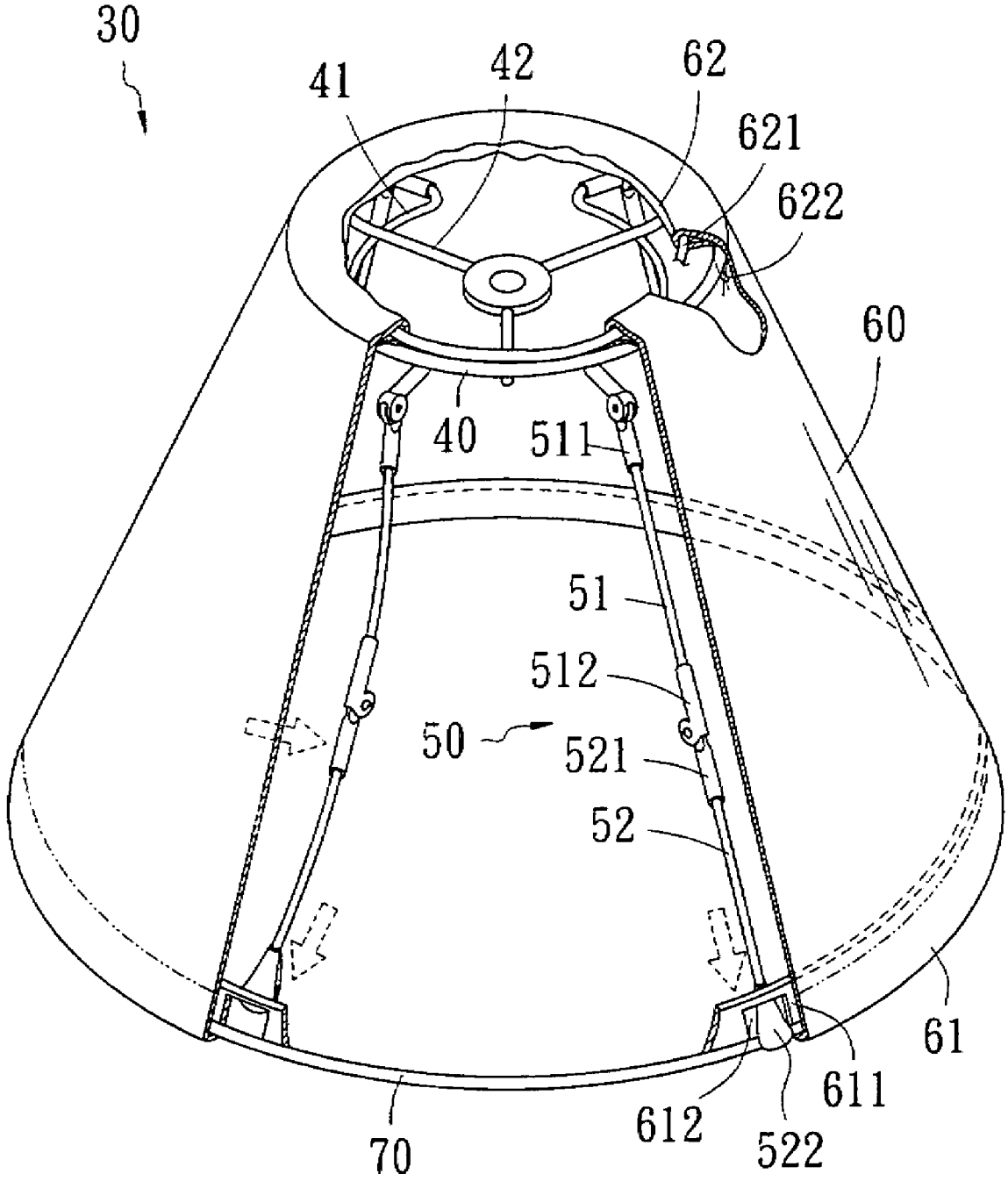
FIG. 10 is a schematic view of the invention showing the collapsible rib and pliable fabric cover in a coupled condition.
Figure 11:
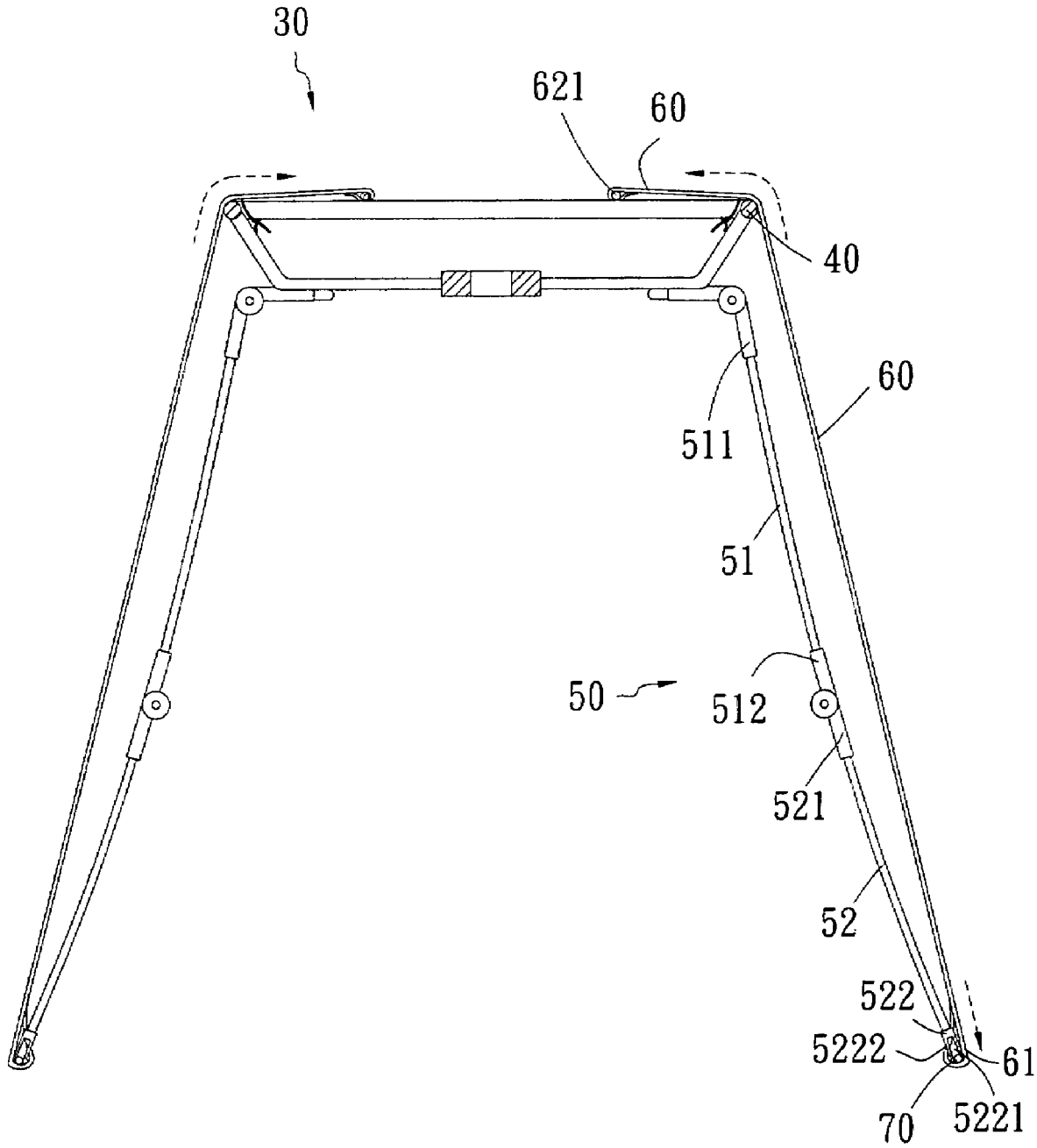
FIG. 11 is a front view of the pliable fabric cover showing the directions of forces on the fabric surface.

Referring to FIGS. 9 and 10, the pliable fabric cover 60 is hollow and has a first stitching portion 61 at a lower rim of the bottom thereof to form a housing space 611 with an insertion hole 612 formed inside. The fabric has an upper rim at the top portion with a second stitching portion 62 formed thereon to encase an elastic strip 621. The bottom rim of the second stitching portion 62 has a fastening element 622 extended therefrom at a desired location to tie the upper ring 40. The upper rim of the fabric is retracted due to the elastic strip 621.

The flexible ring 70 may be made of steel, iron or the like to stretch the bottom of the pliable fabric cover 60. It is threaded through the housing space 611 of the first stitching portion 61 and exposed through the insertion hole 612. Thereby when the collapsible rib 50 is positioned for assembly, the insertion plates 5222 of the secondary bracket 52 are coupled with the flexible ring 70 in the insertion hole 612 to stretch the pliable fabric cover 60 and prevent the collapsible rib 50 from tilting.

The collapsible rib may be formed in multiple sections.

The insertion strut 522 of the secondary bracket 52 may be engaged with the flexible ring 70 by insertion, coupling or engaging of corresponding latch elements.

The pliable fabric cover 60 may be coupled with the upper ring 40 in a movable, semi-fixing or fixing manner. The embodiment is preferably in a semi-fixing manner to allow consumers to alter and replace for different types as desired, and also facilitate storage when not in use.

The connecting portion 512 of the main bracket 51 and the coupling portion 521 of the secondary bracket 52 are connected in a foldable, extendable or coupling manner so that the main bracket 51 and secondary bracket 52 can be disassembled. When the main bracket 51 and secondary bracket 52 are assembled or disassembled, referring to FIG. 10, the connecting portion 512 and the coupling portion 521 are moved closed to or away from each other. The collapsible rib 50 has a desired stiffness to stretch the surface of the pliable fabric cover 60 to generate tension so that the pliable fabric cover 60 becomes smooth and neat.

Referring to FIG. 10, for assembly the upper ring 40 is coupled with the lower rim of the top end of the pliable fabric cover 60; the fastening element 622 is tied on the upper ring 40 to form a semi-fixing fastening; the main and secondary brackets 51 and 52 are extended, and the stiffness of the collapsible rib 50 allows it to be bent slightly; the insertion strut 522 of the secondary bracket 52 is latched on the flexible ring 70 in the insertion hole 612 at the lower rim of the inner side of the pliable fabric cover 60 (referring to FIGS. 9 and 10). Thus the cubical lampshade 30 is formed.

Figure 12:
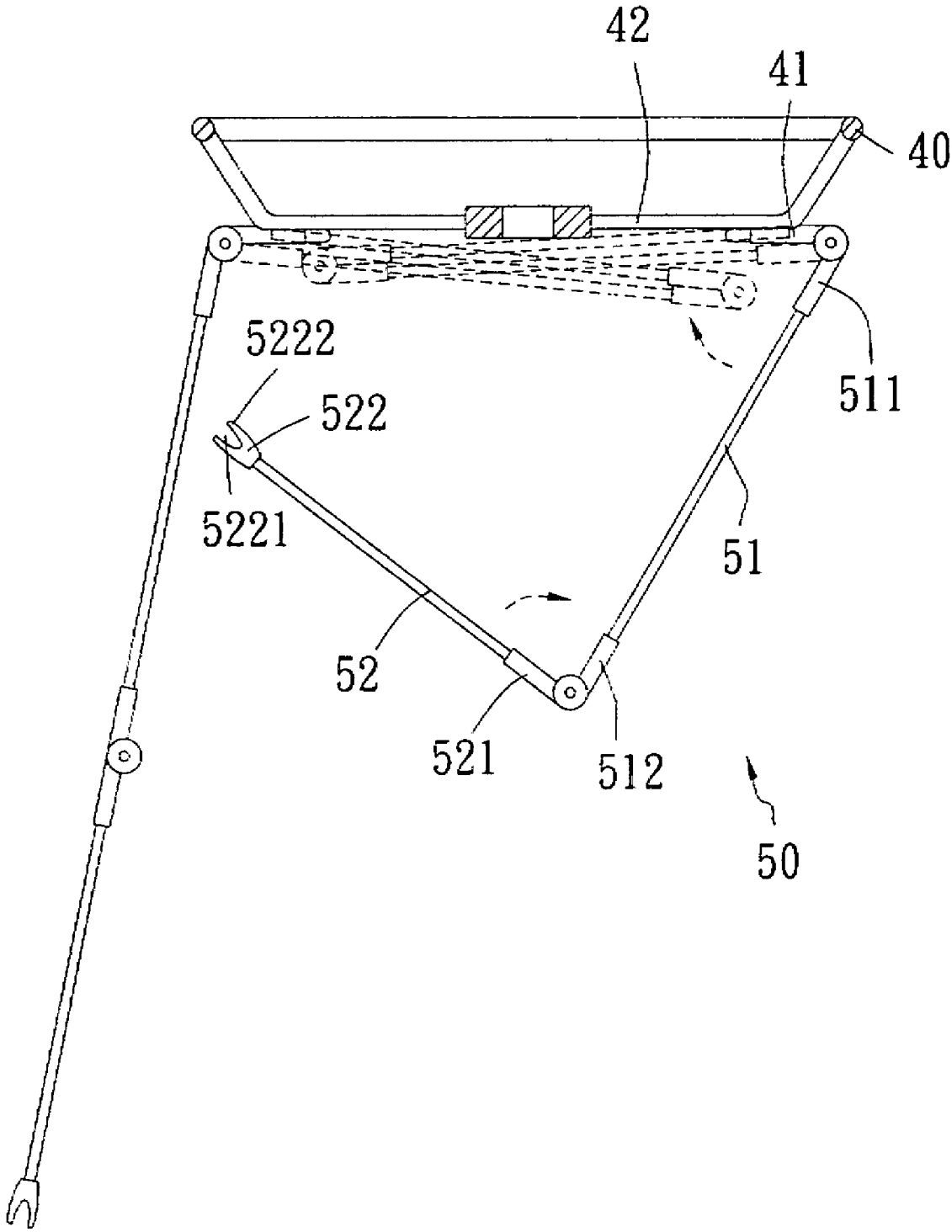
FIG. 12 is a schematic view of the collapsible rib of the invention in a folding condition.
Figure 13:
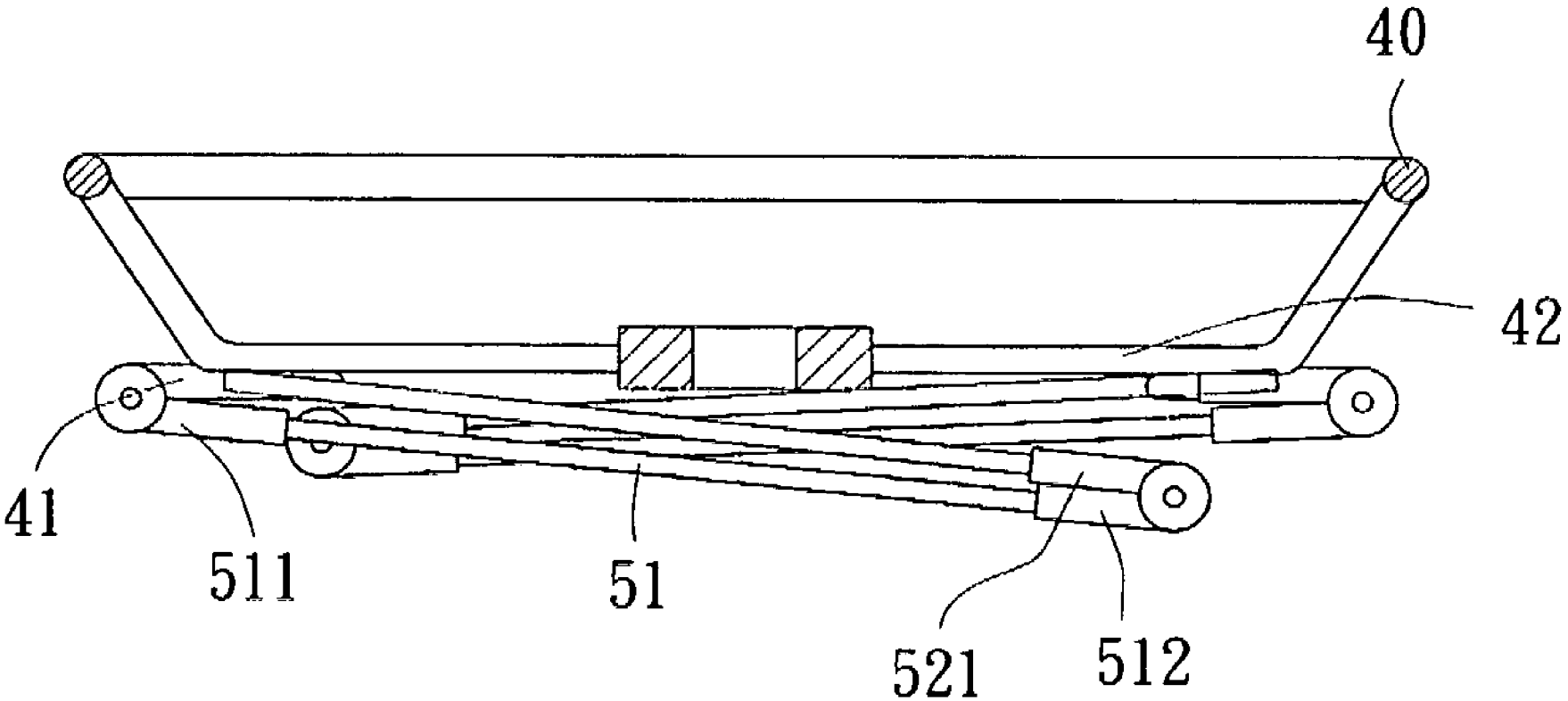
FIG. 13 is a schematic view of the collapsible rib of the invention in a folded condition.
Figure 15:
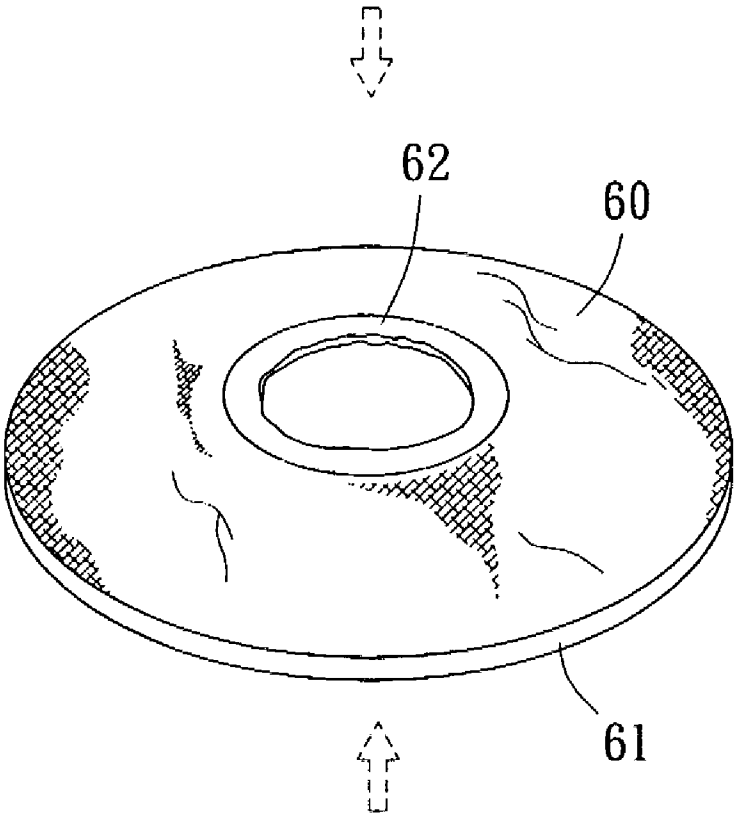
FIG. 15 is a schematic view of the pliable fabric cover of the invention in a folded condition on a cubical surface.
Figure 14:
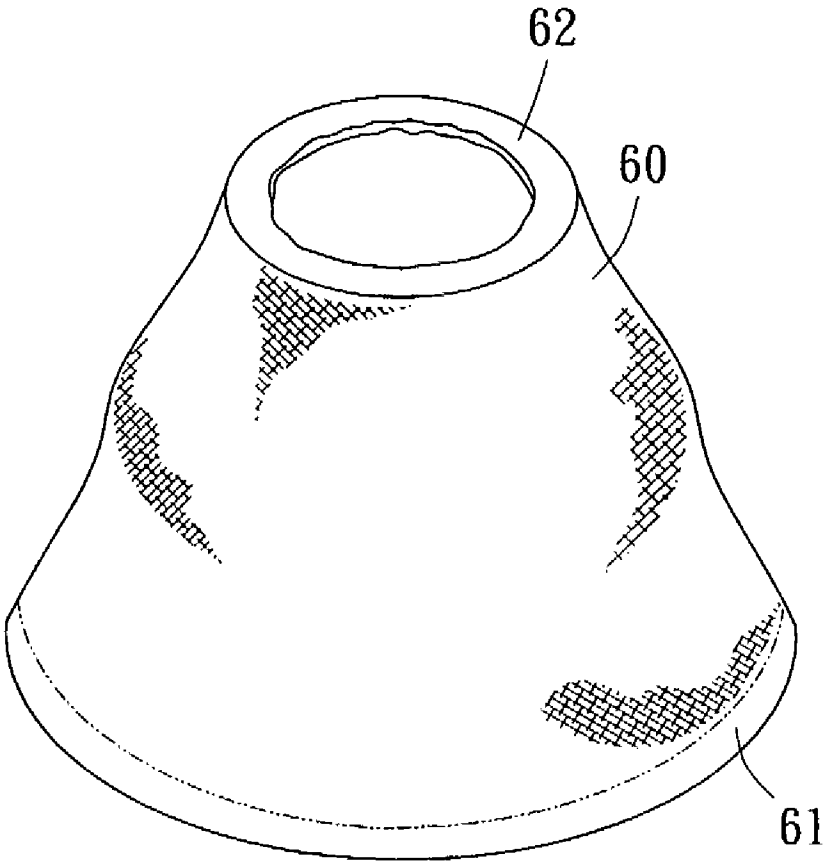
FIG. 14 is perspective view of the pliable fabric cover of the invention.
Figure 17:
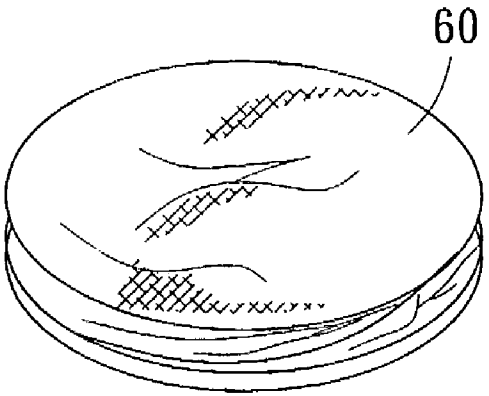
FIG. 17 is a perspective view of the pliable fabric cover of the invention in a folded condition.
Figure 16:
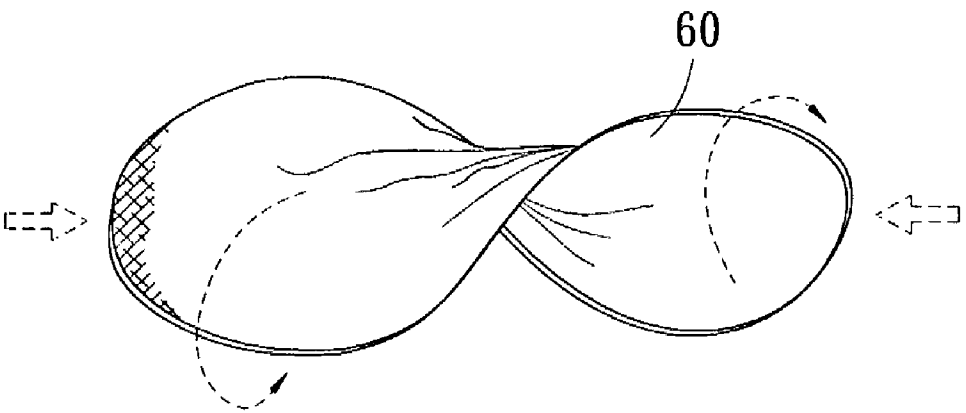
FIG. 16 is a schematic view of the pliable fabric cover of the invention in a folded condition on a plane.
Figure 18:
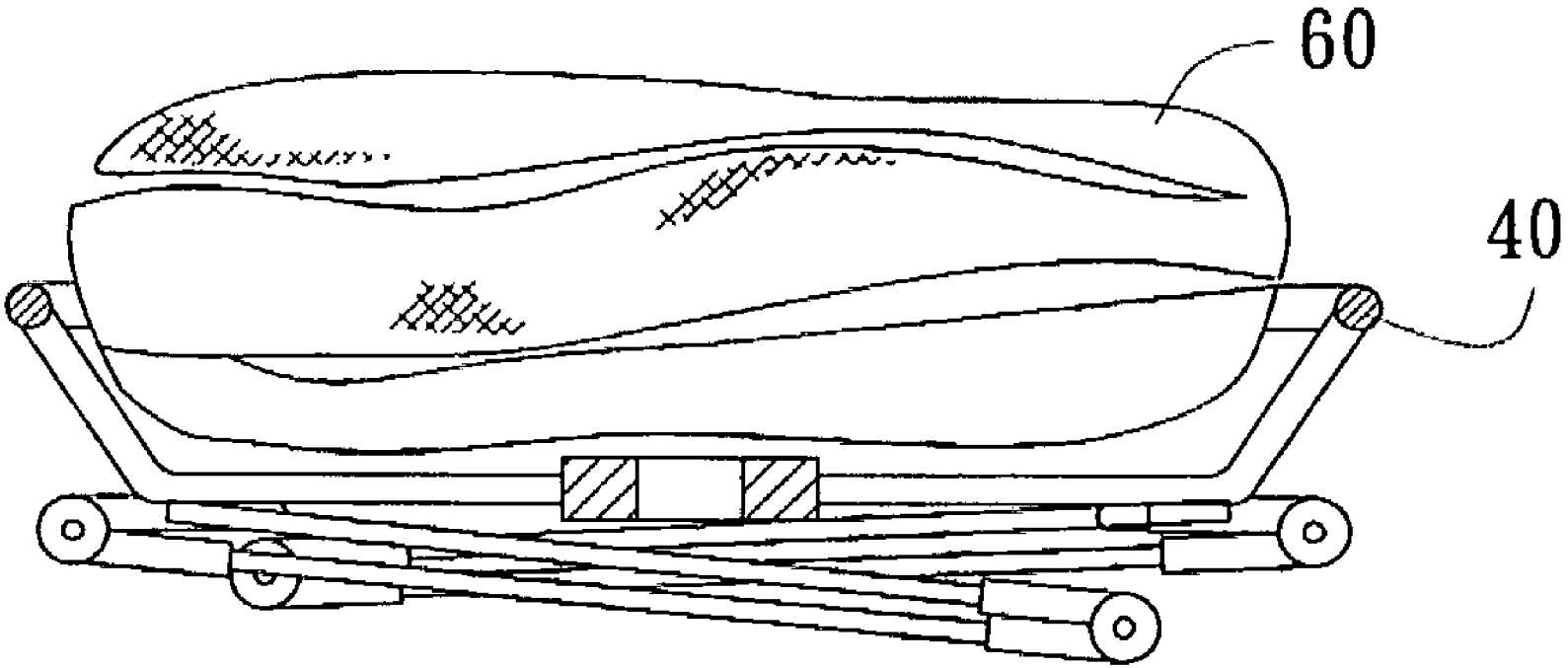
FIG. 18 is schematic view of the pliable fabric cover of the invention in a folded condition and held above the collapsed rib.
Figure 19:
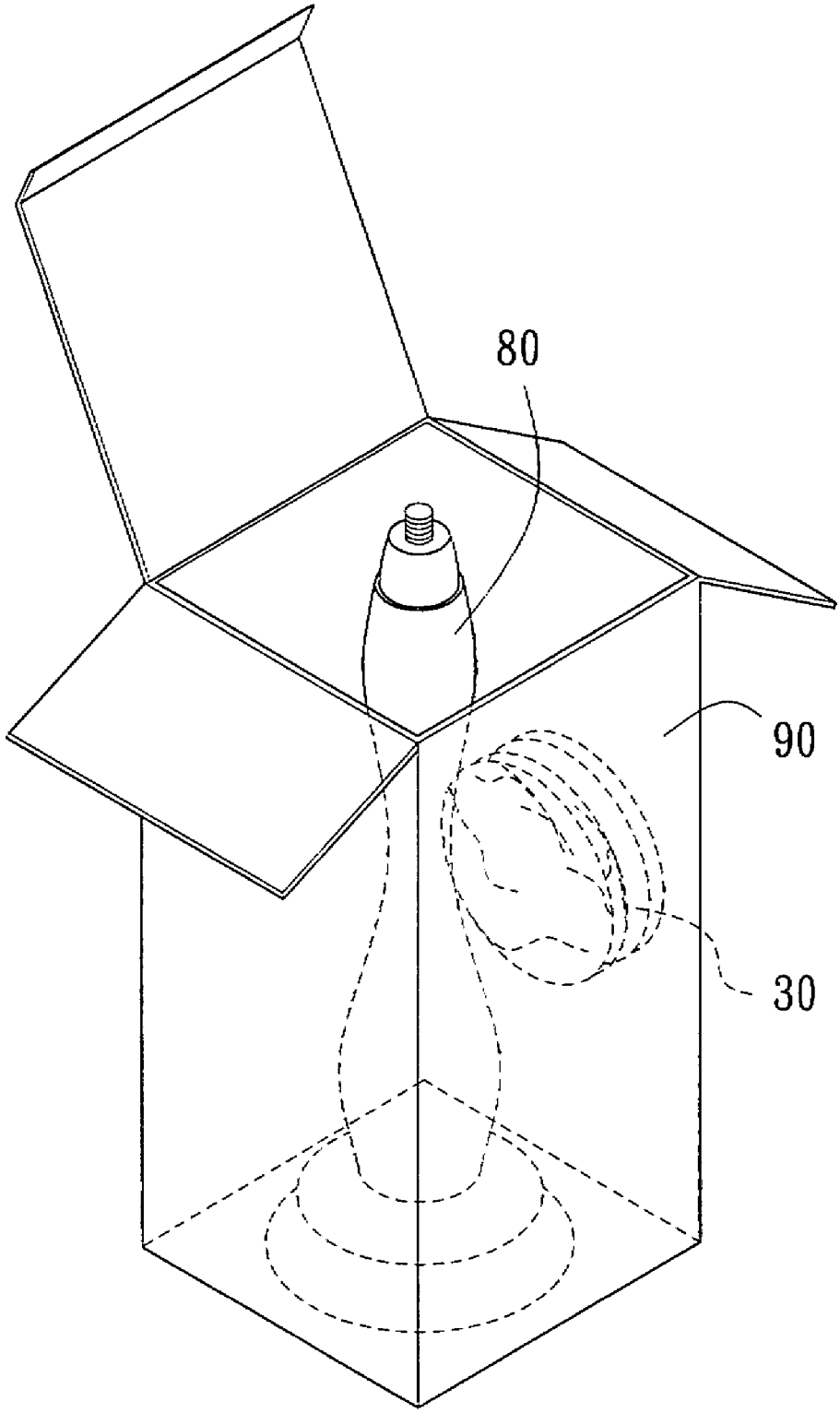
FIG. 19 is a schematic view of the invention held in a package box of a lamp stand.

When the lampshade 30 is not in use, referring to FIG. 12, through the main and secondary brackets 51 and 52, and the pivotal coupling of the upper ring 40 and the main bracket 51, the lampshade 30 can be folded at a lower side of the upper ring 40 as shown in FIG. 13. By adopting a semi-fixing design for the pliable fabric cover 60 and the upper ring 40, the pliable fabric cover 60 can be removed from the collapsible rib 50. As shown in FIG. 13, due to the flexible ring 70 at the bottom of the pliable fabric cover 60 is flexible, the removed pliable fabric cover 60 can be folded in an up and down manner (referring to FIGS. 14 through 17). The folded area is about 1/90 of the extended size (by saving 1/10 of the cubical surface and 1/9 of the plane surface). The folded pliable fabric cover may also be placed on an upper side of the upper ring 40 as shown in FIG. 18, and held in a package box 90 of a lamp stand 80 as shown in FIG. 19 after has been assembled in the plant. Thereby there is no need of additional package material. The cost of package material and transportation is lower.

What is claimed is:

1. A three dimensional collapsible lampshade, comprising:

a collapsible rib foldable on a cubical surface, comprising an upper ring and a plurality of bars, each of said bars having an upper end pivotably coupled with the upper ring and having a lower end, wherein the plurality of bars can be folded into sections and collected under the upper ring in a folded condition; and a pliable fabric cover which is foldable in a plane after being flattened and disposed within a space of the collapsible rib with a bigger edge on the bottom, said pliable fabric cover having a flexible ring at a lower rim thereof coupled to said lower end of each bar, that is flexible in a desired shape and foldable, wherein the flexible ring supports the lower rim when the pliable fabric cover is unfolded and is a retaining portion which can folded into a figure 8 shape and then gathered inside and shaped when the pliable fabric cover is folded;

wherein the collapsible rib and the pliable fabric cover are selectively coupled and extended to form a cubical lampshade and collapsible to form a three dimensional folded condition where the length, width and height thereof are averagely reduced against the volume after the collapsible rib and the pliable fabric cover are disassembled.

* * * * *